United States Patent [19]

Nelson

[11] 4,119,276

[45] Oct. 10, 1978

[54] LAMINAR STREAM SPOUT ATTACHMENT

[76] Inventor: Walter R. Nelson, 2501 Redondo Beach Blvd., Gardena, Calif. 90249

[21] Appl. No.: 819,661

[22] Filed: Jul. 27, 1977

Related U.S. Application Data

[63] Continuation of Ser. No. 663,041, Mar. 2, 1976, abandoned.

[51] Int. Cl.[2] ..... B05B 1/34

[52] U.S. Cl. ..... 239/590.3; 239/590.5

[58] Field of Search ..... 239/428.5, 553.3, 590.3, 239/590.5

[56] References Cited

U.S. PATENT DOCUMENTS

| | | | |
|---|---|---|---|
| 2,316,832 | 4/1943 | Aghnides | 239/590.3 X |
| 2,790,632 | 4/1957 | Mellette | 239/590.3 X |
| 3,173,614 | 3/1965 | Aghnides | 239/428.5 |
| 3,630,444 | 12/1971 | Nelson | 239/590.3 X |
| 3,664,589 | 5/1972 | Jatho et al. | 239/428.5 |
| 3,730,439 | 5/1973 | Parkison | 239/590.3 |

*Primary Examiner*—John J. Love

*Attorney, Agent, or Firm*—Fraser and Bogucki

[57] ABSTRACT

A laminar stream spout attachment which may be threadedly secured to a faucet spout includes a pair of parallel, spaced-apart perforated plates and a pair of screens positioned downstream from the plates. The perforated plates distribute the flow velocity profile more uniformly across the stream diameter and the screens operate to further trim the stream to provide a high quality stream which is clear, straight, free of mist and spray, soft and essentially splash free.

5 Claims, 4 Drawing Figures

Fig. 1
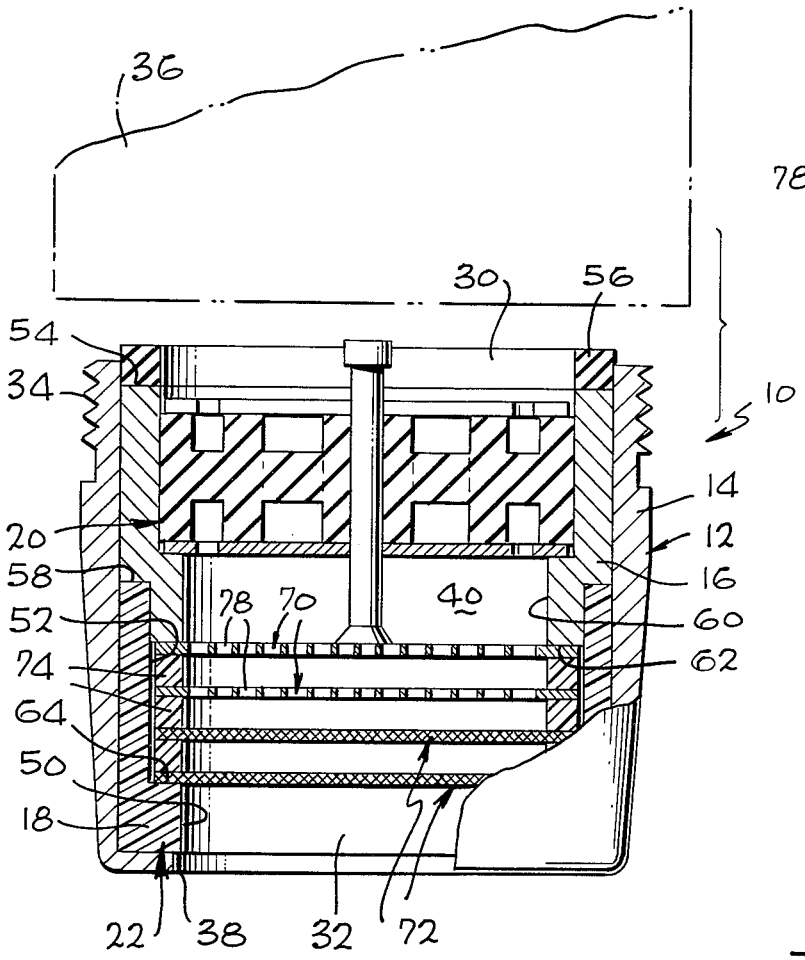
Fig. 2
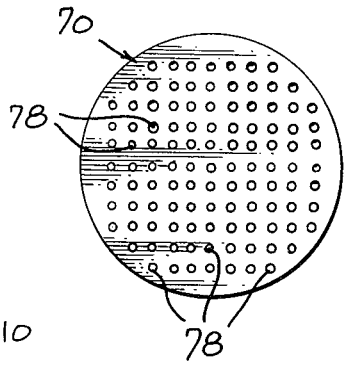
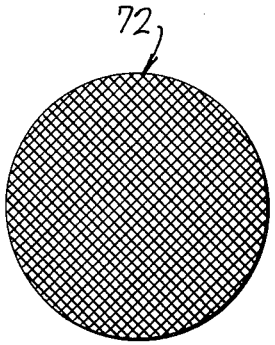
Fig. 3
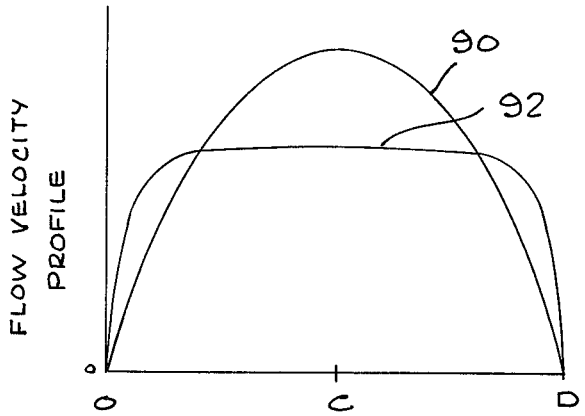
Fig. 4

LAMINAR STREAM SPOUT ATTACHMENT

RELATED APPLICATION

This is a continuation application of Ser. No. 663,041 filed Mar. 2, 1976.

BACKGROUND OF THE INVENTION

1. Field of the invention

This invention relates to attachments to faucet spouts to modify the stream of a fluid flowing therethrough and more particularly to a non-aerating spout attachment having a plurality of parallel, spaced-apart, apertured, flat plates and at least one screen spaced downstream from the plates.

2. Description of the Prior Art

Present day faucet spouts typically have a threaded coupling on the end thereof to receive a mating threaded end of a spout attachment device. Known spout attachments operate to modify the nature or quality of the stream emanating from a spout by aerating the stream, reducing the turbulence of the stream, or otherwise changing the characteristics thereof as it flows through the attachment. However, no known spout attachment provides a high quality non-aerated stream which is clear, free of mist, spray or other turbulence, and so soft that it is essentially splash free with the economy and efficiency of the attachment taught and claimed herein.

SUMMARY OF THE INVENTION

A spout attachment in accordance with the invention provides a laminar stream which is free of turbulence and so soft that it is essentially splash free without aeration. The attachment includes a housing defining a closed, nonapertured sidewall about a central passage having an inlet end and an outlet end longitudinally spaced downstream from the inlet and, at least two longitudinally spaced-apart, parallel flat plates positioned within and extending across the central passage, each of the plates having small apertures therethrough distributed substantially uniformly throughout the plates, and at least one longitudinally spaced screen positioned within and extending across the central aperture, the screen or screens being longitudinally spaced downstream from the plates and parallel therewith. The central passage has substantially straight and smooth sidewalls in the longitudinal direction and a substantially constant crosssectional area throughout its length. A large number of apertures are uniformly distributed throughout each plate to provide a substantially uniform flow velocity profile across the entire central passage and have a total aperture area between 30% and 35% of the total area of each plate. To obtain the desired flow velocity profile, the apertured plates are preferably separated by a distance of at least approximately one aperture diameter, but no more than about 2½ to 3 aperture diameters.

BRIEF DESCRIPTION OF THE DRAWINGS

A better understanding of the invention may be had from a consideration of the following detailed description taken in conjunction with the accompanying drawings in which:

FIG. 1 is a side view, partially broken away, of a laminar stream spout attachment in accordance with the invention;

FIG. 2 is a plan view of an apertured plate for the spout attachment shown in FIG. 1

FIG. 3 is a plan view of a screen for the spout attachment shown in FIG. 1 and

FIG. 4 is a diagram illustrating the improved flow characteristics provided by the spout attachment shown in FIG. 1.

DETAILED DESCRIPTION

As shown in FIG. 1, a laminar stream spout attachment 10 in accordance with the invention includes a housing 12 having a housing shell 14, an upper cartridge 16, and a lower cartridge 18, a flow control assembly 20 and a laminar stream assembly 22. The flow control assembly 20 is not an essential feature of the present invention and may be of the type described in copending application Ser. No. 558,071 filed Mar. 13, 1975 for FLOW CONTROL DEVICE.

The housing shell 14 extends with a generally cylindrical shape from an inlet end 30 to an outlet end 32 longitudinally spaced downstream of the inlet end 30. External threads 34 are provided on the shell 14 near the inlet end 30 for coupling to a faucet spout indicated at 36. It will be appreciated that internal threads might alternatively be located adjacent the inlet end 30. At the outlet end 32, the shell 14 terminates in a flange 38 which extends radially inward toward a central passage 40. The lower cartridge 18 is a resilient, generally annular member having an internal circumference 50 and an annular notch 52 in the internal circumference 50. The lower cartridge 18 is disposed in abutment with an inside surface of flange 38 and also in abutment with the inside cylindrical sidewall of housing shell 14. The notch 52 extends longitudinally from a position spaced a short distance from flange 38 to the end of cartridge 18 adjacent the inlet end 30. The upper cartridge 16 is a resilient generally annular member having a notch 52 mating with lower cartridge 18 in a lap joint and extends in mating relationship with the interior sidewall of shell 14 longitudinally upstream from the notch 52 to an end 54 adjacent the inlet end 30 of spout attachment 10. A washer 56 is disposed adjacent the end 54 to make a sealing compression coupling between the end 54 and a spout 36 to maintain the cartridges 16 and 18 in contact with each other as well as flange 38. Two diametrically opposed mating and notch pairs (not shown) may be positioned along a mating surface 58 between the upper and lower cartridges 16, 18 to couple the two cartridges together and prevent relative rotation therebetween. An interior surface 60 of upper cartridge 16 is substantially coterminous with the interior surface 50 of lower cartridge 18 to provide the central passage 40 with nearly equal cross-sectional areas on opposite upstream and downstream sides of the laminar stream assembly 22.

The laminar stream assembly 22 extends from a downstream end 62 of upper cartridge 16 longitudinally downstream toward a downstream termination of notch 52 at a surface 64. The laminar stream assembly 22 includes two flat, parallel, spaced-apart apertured plates 70, two flat, parallel, spacedapart screens 72 and annular spacer rings 74 positioned between each adjacent pair of plates 70 and screens 72. While two plates 70 and two screens 72 are illustrated by way of example, it should be appreciated that the number of each may be increased without detracting from the performance of the invention. In fact, it has been found that only one screen 72 is required if at least three perforated plates 70 are employed in the laminar stream assembly 22.

It is important that the spacer washers 74 have an internal circumference which is co-extensive with internal surfaces 50 and 60 to provide the central passage 40 with straight smooth walls in the longitudinal direction and a uniform cross-sectional area throughout the region of the laminar stream assembly 22.

Referring more particularly to FIG. 2, in a preferred example, the flat, circular plates 70 are made from brass sheet or strip with a thickness of about 0.016 inch (0.041 cm). The apertures 78 through plates 70 are arranged in a matrix of rows and columns with a uniform center-to-center spacing of about 0.044 inch (0.112 cm) along both the rows and columns to provide a density of 500 apertures per square inch (77.5 apertures per square cm). With an aperture diameter of 0.028 inch (0.071 cm) the total area of the apertures 78 is approximately 31% of the total area of each plate 70. It has been found that in order to obtain the high quality, non-turbulent laminar flow of which this invention is capable, the total area of the apertures of each plate should be between 30% and 35% of the total area of each plate. It is also important that there be a large number of small holes uniformly distributed across the entire portion of a plate 70 which intercepts the central passage 40, although the exact pattern in which the apertures 78 are arranged is not critical.

It is furthermore necessary that the distance between plates 70 relative to the diameter of the apertures 78 be such as to enable the stream to adjust and redistribute after it passes through the first or upstream plate to provide the desired uniform velocity profile. It has been determined that the plate separation distance should fall between about one aperture diameter and about 2½ or 3 aperture diameters. Thus, in the embodiment under discussion, the distance between plates may range from about 0.028 inch (0.071 cm) to about 0.084 inch (0.213cm). In accordance with one practical example of the invention, a distance of about 0.050 inch (0.127 cm) is employed. The same distance separates the lower plate 70 from the upper screen 72 and applies as well to the distance between the two screens 72. Thus, all of the spacers 74 have about the same height of 0.050 inch (0.127 cm).

Referring now to FIG. 3, in the preferred example, each screen 72 has a 40-square mesh and is made from monel or stainless steel wire having a diameter of 0.010 inch (0.025 cm). In this example, each of the screens 72 is in the shape of a flat circle. It has been found that only one screen 72 is sufficient if at least three plates 70 are employed in the attachment 10.

The substantial improvement in stream quality which is obtained with the spout attachment 10 in accordance with the invention may be further understood with reference to the diagram shown in FIG. 4. The horizontally extending dimension represents distance along a diameter of the central passage 40 adjacent the outlet end 32 with one extremity of the diameter indicated by 0, the other extremity of the diameter indicated by D, and the circular center indicated at C. The vertical axis indicates a flow velocity profile increasing vertically upward from 0 at the horizontal axis. As indicated by curve 90, a fluid stream with laminar flow typically has a parabolically shaped flow pattern with substantially zero flow adjacent the sidewall and a maximum flow velocity near the center of the flow passage. However, the parallel spaced-apart plates 70 and screens 72 of the present invention modify the flow velocity pattern and redistribute the stream kinetic energy to provide a much more uniform and constant flow velocity across the entire cross-sectional area of the central passage 40. As a result, the flow velocity profile indicated by curve 92 is attained with a much broader, flatter and lower magnitude peak. Because the velocity is more uniformly distributed over the entire crosssectional area of the stream, the maximum velocity is reduced to provide a softer, essentially splash free stream and turbulence resulting from flow velocity changes across a diametric plane of the stream is substantially eliminated.

Although a laminar stream spout attachment in accordance with the invention has been described and illustrated for the purpose of enabling a person of ordinary skill in the art to make and use the invention, it will be appreciated that the invention is not limited thereto. Accordingly, any modifications, variations or equivalent arrangements within the scope of the attached claims should be considered to be within the scope of the invention.

What is claimed is:

1. A laminar stream spout attachment comprising:

a housing defining a closed, nonapertured sidewall about a cylindrical, smooth central passage having an inlet and an outlet longitudinally spaced downstream from the inlet;

at least two longitudinally spaced-apart, parallel plates positioned within and extending across the central passage, each of the plates having small apertures therethrough distributed substantially uniformly throughout the plates, the area of the apertures in each plate being between about 30% and about 35% of the total plate area thereby reshaping the flow velocity profile of the stream in the central passage to have greater uniformity across the central passage, the longitudinal spacing between the plates being between about one aperture diameter and about three aperture diameters; and at least two longitudinally spaced, parallel screens positioned within and extending across the central passage the screens being longitudinally spaced downstream from the plates.

2. The laminar stream spout attachment according to claim 1 above, wherein the plates are substantially flat and of uniform thickness throughout and wherein the density of apertures in the plates is at least 500 apertures per square inch (77.5 apertures per square cm).

3. A laminar stream spout attachment comprising:

a housing defining a closed, nonapertured sidewall about a cylindrical, smooth-walled central passage having an inlet and an outlet longitudinally spaced downstream from the inlet;

at least three longitudinally spaced-apart parallel plates positioned within and extending across the central passage, each of the plates having small apertures therethrough distributed substantially uniformly throughout the plates, the area of the apertures in each plate being between about 30% and about 35 % of the total area of the plate, the plates being separated a distance between about one aperture diameter and about three aperture diameter; and at least one screen positioned within and extending across the central passage, the at least one screen being longitudinally spaced downstream from the plates and parallel thereto.

4. The laminar stream spout attachment according to claim 3 above, wherein the plates are substantially flat and of uniform thickness throughout and wherein the density of apertures in the plates is at least 500 apertures per square inch (77.5 apertures per square cm).

5. A laminar stream spout attachment comprising:

a generally cylindrical nonapertured housing shell having an open inlet end adapted for coupling to a spout and an open outlet end longitudinally spaced downstream from the inlet end, the shell terminating at the outlet end in a flange extending inward a short distance toward a central passage through the shell;

a notched, annular cartridge disposed in mating relationship with the interior of the shell and in abutment with the flange, the notched cartridge having an annular notch in an interior surface thereof beginning at a position longitudinally spaced upstream from the flange and extending toward the inlet end, the notched cartridge having interior sidewalls defining a lower portion of a central passage between the notch and the flange;

a plurality of flat plates positioned to intercept the central passage in the vicinity of the annular notch, each of the plates having a plurality of small apertures distributed substantially uniformly therethrough with a total aperture area between 30% and 35% of the area of a plate;

at least one screen positioned longitudinally downstream of the plates to intercept the central passage in the vicinity of the annular notch; and a plurality of annular spacer washers disposed within the notch between each adjacent plate and screen, the spacer washers having a thickness between about one aperture diameter and about three aperture diameters in the longitudinal direction and an interior circumference in substantial conformity and alignment with the lower portion of the central passage to complete the definition of a central passage through the housing shell past the plates and at least one screen, the central passage having a straight, smooth boundary in the longitudinal direction and a substantially uniform cross-sectional area, the spout attachment providing fluid jet from the outlet end with a high quality laminar flow having a substantially uniform flow velocity throughout a cross-sectional area coterminous with the central passage.

* * * * *